US005969282A

United States Patent [19]

Berners et al.

[11] Patent Number: 5,969,282

[45] Date of Patent: Oct. 19, 1999

[54] METHOD AND APPARATUS FOR ADJUSTING THE PITCH AND TIMBRE OF AN INPUT SIGNAL IN A CONTROLLED MANNER

[75] Inventors: David P. Berners, Mountain View; William R. Ciullo, Fremont, both of Calif.

[73] Assignee: Aureal Semiconductor, Inc., Fremont, Calif.

[21] Appl. No.: 09/124,178

[22] Filed: Jul. 28, 1998

[51] Int. Cl.[6] ..... G10H 1/06

[52] U.S. Cl. ..... 84/603; 84/660

[58] Field of Search ..... 84/607, 622–625, 84/659–661, 603

[56] References Cited

U.S. PATENT DOCUMENTS

| | | | |
|---|---|---|---|
| 4,282,790 | 8/1981 | Wachi | 84/623 |
| 4,351,219 | 9/1982 | Bass | 84/622 X |
| 4,418,600 | 12/1983 | Wachi | 84/624 |
| 4,440,058 | 4/1984 | Bass et al. | 84/607 |
| 4,597,318 | 7/1986 | Nikaido et al. | 84/625 |
| 5,231,671 | 7/1993 | Gibson et al. . | |

OTHER PUBLICATIONS

Lent, Keith "An Efficient Method for Pitch Shifting Digitally Sampled Sounds" *Computer Music Journal*, University of Texas v. 13, No. 4, (1989) pp. 65–71.

*Primary Examiner*—Stanley J. Witkowski
*Attorney, Agent, or Firm*—Beyer & Weaver, LLP

[57] ABSTRACT

A system and method are disclosed for independently adjusting the pitch and timbre of an input signal within a modified Lent shifter. A method of adjusting the pitch and timbre of an input signal includes receiving an input signal and determining a window length corresponding to the input signal. A finite length spectrally smoothed signal is created from the input signal by synchronously windowing the input signal. The timbre of the finite length spectrally smoothed signal is adjusted thereby creating a finite length timbre adjusted signal. The finite length timbre adjusted signal is recombined at a rate necessary to produce a desired output pitch thereby reducing artifacts introduced by processing the finite length timbre adjusted signal and minimizing latency between receiving the input signal and producing a desired output signal.

17 Claims, 7 Drawing Sheets

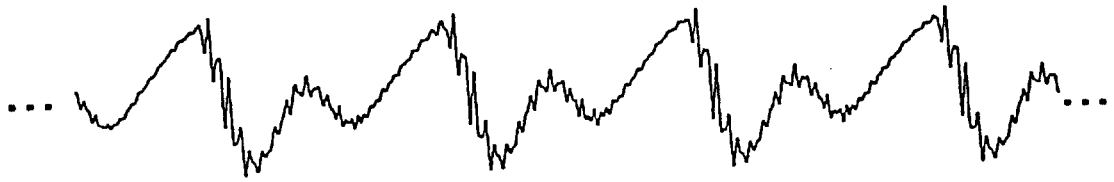
FIG. 2A Continuous Time Signal
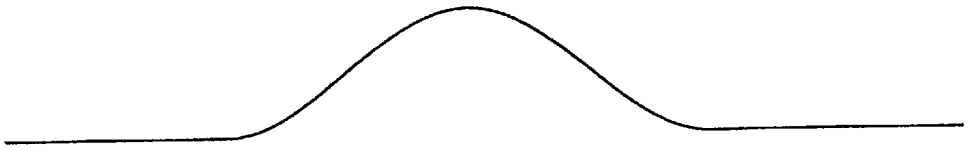
FIG. 2B Window Function
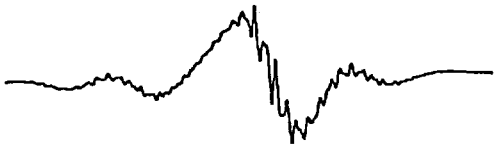
FIG. 2C Windowed Time Signal

METHOD AND APPARATUS FOR ADJUSTING THE PITCH AND TIMBRE OF AN INPUT SIGNAL IN A CONTROLLED MANNER

BACKGROUND OF THE INVENTION

1. Field of the Invention

The present invention relates generally to the field of electronic audio effects. In particular, it relates to methods and systems for adjusting the pitch and sound of audio signals.

2. Discussion of the Related Art

Pitch shifting has a wide variety of applications in audio. For polyphonic music, pitch shifting can be used to change the key of a musical passage by one or more semitones up or down. Pitch shifting can also be used on a scale smaller than one semitone in order to adjust intonation. This technique is valuable for mixing together different previously recorded segments of music which may be detuned from each other, or for correcting intonation problems in a performance. For monophonic (single pitch) musical sources, including speech, pitch shifting can be used for both of these applications as well as for adding harmonization to a melodic line.

The most common pitch shifting algorithms for audio signals are based on resampling. Resampling pitch shifters sample the input audio stream at one sampling rate, and output the sampled data at a different sampling rate. For shifting pitch upwards, the output sampling rate is higher than the input sampling rate; for shifting pitch downwards, the output sampling rate is lower than the input sampling rate. In order to preserve the time length of the signal, resampling pitch shifters divide the audio stream into short separate time segments (on the order of 200 mS) and recombine those segments with varying degrees of overlap after resampling the segments. For a given input sample rate, to preserve the time length of a signal, the amount of overlap between time segments will increase as the output sample rate decreases. Resampling pitch shifters can be used with previously recorded audio or in real time with some latency between input and output.

For single pitch harmonic musical sources, the pitch of a particular signal is associated with a fundamental frequency of the note which is defined as 1/T, where T is the time length of the signal's period. For example, the pitch known as A above middle C has a fundamental frequency of 440 Hz. The timbre of a musical note is associated with the harmonic structure of the note. Timbre is perceptually related to the "character" or "sound" of a note. It is timbre which distinguishes a man's voice from a woman's singing the same note, or the sound of a French horn from the sound of a trumpet. The relative weights of the harmonics present in a periodic signal are known collectively as its spectral envelope, and determine its timbre. For the case of human voice signals, if the spectral envelope of a signal retains its shape but is stretched along the frequency axis, the resulting signal will sound "deeper" or "bigger" than the original, but will have the same vowel sound. If, on the other hand, the spectral envelope is compressed while keeping the same shape, the resulting signal will sound "thinner" or "smaller" than the original, again with the vowel sound retained.

Resampling pitch shifters scale every frequency present in a signal by a constant factor. For example, if a signal is shifted up an octave by a resampling pitch shifter, every frequency present in the original signal will appear at double the frequency in the output signal. This means that not only will the pitch of the output signal be an octave higher than the original signal, but the spectral envelope will be stretched by a factor of two with respect to the original. Similarly a signal which is pitch shifted down will have its spectral envelope compressed. Thus, the timbre of a signal is altered by a resampling pitch shifter.

FIG. 1 shows time domain waveforms for a harmonic signal. As can be seen, signal 106 is a time-stretched version of signal 102. The period 108 of signal 106 is longer than the period 104 of signal 102. Thus the pitch of signal 106 is lower than the pitch of signal 102. Since the features of sianal 106 are time-stretched compared to those of signal 102, the timbre of signal 106 is "deeper" than that of signal 102. Signal 110 is a time-compressed version of signal 102. The period 112 of signal 110 is shorter than the period 104 of signal 102. Thus the pitch of signal 110 is higher than the pitch of signal 102. Since the features of signal 110 are time-compressed relative to those of signal 102, the signal 110 has a "thinner" timbre than signal 102. For both altered signals, the spectrum is compressed or stretched by an amount determined by the amount of pitch modification.

For many audio signal processing applications it is desirable for the timbre of a sound to change as its pitch changes. For example, a trumpet sound shifted down by an octave will fall in the musical pitch range common for a trombone. If the pitch shift is accomplished with a resampling pitch shifter, the spectral envelope will be compressed by a factor of two, which will result in a timbre similar to that of a trombone. The overall effect of the resampling pitch shift will then be to "transform" the sound of the trumpet note to a sound that resembles a trombone tone both in pitch and timbre. This same fortunate circumstance applies to many musical instruments. A notable exception is the human voice.

The human voice has the unique feature that over a wide range of pitch, the timbre of the voice remains similar. Moreover, the human ear is attuned to human voice signals, so small changes in timbre have a large perceptual effect when dealing with human voices. Changes in the shape of the spectral envelope are perceived as changes in vowel sounds, while, as mentioned above, stretching of the spectral envelope is perceived as a change in deepness of the voice. Unfortunately, the scale by which the spectral envelope of a human voice signal can be stretched and still sound human is small. As a result, pitch shifting by more than a small musical interval using a resampling pitch shifter results in an unnatural sound for human voice signals. For example, a human voice which is shifted down by half an octave using a resampling pitch shifter might be described as having a "Darth Vadar" quality, while a voice which is shifted up by half an octave using resampling might have a "chipmunk" quality.

Further compromising the usefulness of resampling pitch shifters for voice signals are the artifacts introduced by the recombination of the overlapping time segments. As each segment begins and ends, the amplitude of the output signal is increased and decreased. This results in amplitude modulation in the output. Also, while overlapping segments are added together, there are two sources of correlated data which are being combined. This results in comb filtering at the output. Thus, there are various kinds of distortion introduced by resampling pitch shifters, some of which are perceived as time domain artifacts and some of which appear as frequency domain filtering. Also, as mentioned above, resampling pitch shifters cannot work in real time without latency between the input and output signals.

Other processes exist for changing the pitch of an audio signal without changing the signal's spectral envelope.

When applied to human voice signals, these processes are referred to as fixed-format pitch shifters. The most popular algorithm for fixed-format shifting is known as the Lent algorithm, or the pitch-synchronous overlap-add algorithm. The Lent algorithm requires the ability to periodically window the input signal in a synchronous fashion, i.e., the window length must be related to the pitch period of the input signal. This in turn requires that the input signal have a single pitch. In other words, Lent shifting is possible only for monophonic (single-pitch) sources.

The Lent pitch shifter, when applied to human voice, results in an output which has a different pitch than the input, but the same timbral characteristics. Harmonies generated by the Lent shifter will sound as though they were sung by the same person who sang the original notes, preserving the human quality of the voice. This is desirable in many circumstances.

The Lent shifter works as follows: The input signal is first applied to a pitch detector. There are several known methods of pitch detection, including autocorrelation methods and low-pass filter/zero crossing detector methods. A pitch detector suitable for use in a Lent shifter is available from Aureal Semiconductor, Inc. of Fremont, Calif. The pitch detector provides the period T of the harmonic input signal. The signal is then periodically windowed by a Hanning window or other suitable window of length greater than or equal to 2T. The exact window function used is not critical but it is desirable to use a window with small sidelobes. FIGS. 2*a*–2*c* show the windowing process. FIG. 2*a* is a continuous, infinite length time signal. FIG. 2*b* shows a window function whose length is equal to two periods of the signal in 2*a*. FIG. 2*c* shows the windowed signal, which is the product of the window function and the time signal. This signal is finite length, since the window function is only nonzero for a finite time.

The window spectrally smooths the signal, eliminating the fine structure of the spectrum. This removes any pitch associated with the input signal, and leaves only the spectral envelope or timbral information. The windowed data segments are recombined at a rate 1/T', where T' is the desired output period for the signal. This impresses the desired pitch on the windowed data. If T' is set to a constant, the output signal will have a fixed musical pitch. If on the other hand T' is computed as a fixed (fractional) multiple of T, the output pitch will be a fixed musical interval from the input pitch.

The resampling pitch shifter changes the pitch of a signal and stretches its spectral envelope, both by the same factor. The Lent shifter changes the pitch of a signal without changing the spectral envelope, or timbre. For some applications it is desirable to be able to process an audio signal to change its pitch and timbre independently. An example would be creating harmonies for a vocal melody whose timbre is similar but not identical to the timbre of the original melody. This would result in the accompanying harmony voices sounding like a different person, but still sounding human. The resampling pitch shifter and Lent shifter can be combined to create a device that gives independent control over the pitch and timbre of an input audio signal. Such a device is shown in FIG. 3. An audio input signal 301 is first routed to a resampler 307 where the timbre and pitch are adjusted producing an intermediate signal 305. Since a resampler is used, the fundamental frequency is modified by the same factor by which the spectral envelope is stretched. This intermediate signal is then sent through a Lent shifter 307 for adjusting the pitch of the signal. However, an output signal 309 from such a device retains the artifacts of both the resampler and the Lent shifter. In addition, each of the two pitch shifters in the system require separate memory and processing power which make the entire algorithm computationally expensive.

Therefore it would be desirable to have a pitch and timbre adjusting mechanism that does not have the overhead or expense of having a resampling step followed by a Lent shifting step. It would also be desirable to reduce artifacts introduced by signal processing. Finally, it would be desirable to minimize the latency from input to output of the algorithm. Small latencies are essential for any application which is used for real time performance, since any perceptible latency from input to output would be frustrating to a performer.

SUMMARY OF THE INVENTION

To achieve the foregoing, and in accordance with the purpose of the present invention, methods and apparatus for independently adjusting the pitch and timbre of an input signal within a modified Lent shifter is described. In a specific embodiment of one aspect of the invention, a method of adjusting the pitch and timbre of an input signal requires receiving an input signal and determining a window length corresponding to the input signal. A finite length spectrally smoothed signal is created from the input signal by synchronously windowing the input signal. The timbre of the finite length spectrally smoothed signal is adjusted thereby creating a finite length timbre adjusted signal. The finite length timbre adjusted signal is recombined at a rate necessary to produce a desired output pitch thereby reducing artifacts introduced by adjusting the timbre of the finite length signal rather than the continuous input and minimizing latency between receiving the input signal and producing a desired output signal.

In another aspect of the present invention, an apparatus for independently shifting the pitch and the timbre of an input signal in a controlled manner is described. In a specific embodiment, the apparatus includes a pitch detector for determining a window length of an input signal having a distinguishable pitch. A synchronous windower creates a spectrally smoothed signal of finite length. A resampler adjusts the timbre of the spectrally smoothed signal thereby creating a timbre adjusted signal also of finite length. A recombiner combines the timbre adjusted signal by overlap adding at a rate necessary to produce a desired output pitch, wherein artifacts introduced from processing the spectrally smoothed signal and the timbre adjusted signal are reduced.

In yet another aspect of the present invention, a modified Lent shifter capable of independent timbre and pitch adjustment is described. In a specific embodiment, a pitch detector measures the period of an input signal. A synchronous windower spectrally smoothes the input signal by synchronously windowing the input signal thereby creating multiple windowed data having finite lengths. A resampling timbre adjuster adjusts the timbre of the input signal using the multiple finite length windowed data and a resampling ratio. A pitch adjusting recombiner combines the multiple windowed data by overlap adding at a desired rate.

BRIEF DESCRIPTION OF THE DRAWINGS

The invention, together with further advantages thereof, may best be understood by reference of he following description taken in conjunction with the accompanying drawings in which:

FIGS. 2*a*, 2*b*, and 2*c* are illustrations of a window function being applied to a continuous audio signal resulting in a finite length time signal.

DETAILED DESCRIPTION OF THE PREFERRED EMBODIMENTS

Reference will now be made in detail to a preferred embodiment of the invention. An example of the preferred embodiment is illustrated in the accompanying drawings. While the invention will be described in conjunction with a preferred embodiment, it will be understood that it is not intended to limit the invention to one preferred embodiment. To the contrary, it is intended to cover alternatives, modifications, and equivalents as may be included within the spirit and scope of the invention as defined by the appended claims.

An improved method for independently adjusting the pitch and timbre of a musical note, which reduces latency, memory requirements, and artifacts produced by processing, is illustrated in the various drawings. This method is a modification of the Lent algorithm to allow timbre adjustment to be accomplished as well as pitch adjustment.

In the described embodiment, resampling is performed on the finite length windowed data within the Lent shifter to produce a change in timbre. Since the windowed data is finite in length, the resampling can be accomplished in real time without separating the data into segments, as in the case of the conventional resampling pitch shifter. In this way the artifacts associated with the recombination of data segments can be avoided. Also, since the windowed data within the pitch shifter is relatively short (30 mS maximum), the latency caused by resampling this data is typically no longer than 8 mS, compared with a typical latency of 50 mS for a resampling pitch shifter operating on a continuous input signal. Latencies of 8 mS are imperceptible to the human ear, while latencies of 50 mS or greater can be perceived. The windowed data within the Lent shifter can be short because the Lent shifter windows the data in a synchronous fashion, whereas the typical resampling pitch shifter uses a data-independent algorithm. With the data-independent algorithm, the segment size must be much longer than the period of the lowest frequency present in the signal in order to prevent beating between the segment length and the period length, which is perceived as a "lumpy" bass sound. This leads to a large latency.

In the described embodiment, a data buffer used by the resampling pitch shifter can be eliminated completely, since the resampling is performed on the windowed data within the Lent shifter. This buffer is typically on the order of 50 mS, which leads to savings of about two thousand samples of memory at CD sampling rates. Also, the algorithm becomes more efficient because the processing involved in separating the input stream into segments by the resampler and later recombining those segments can be avoided.

Figure 1:
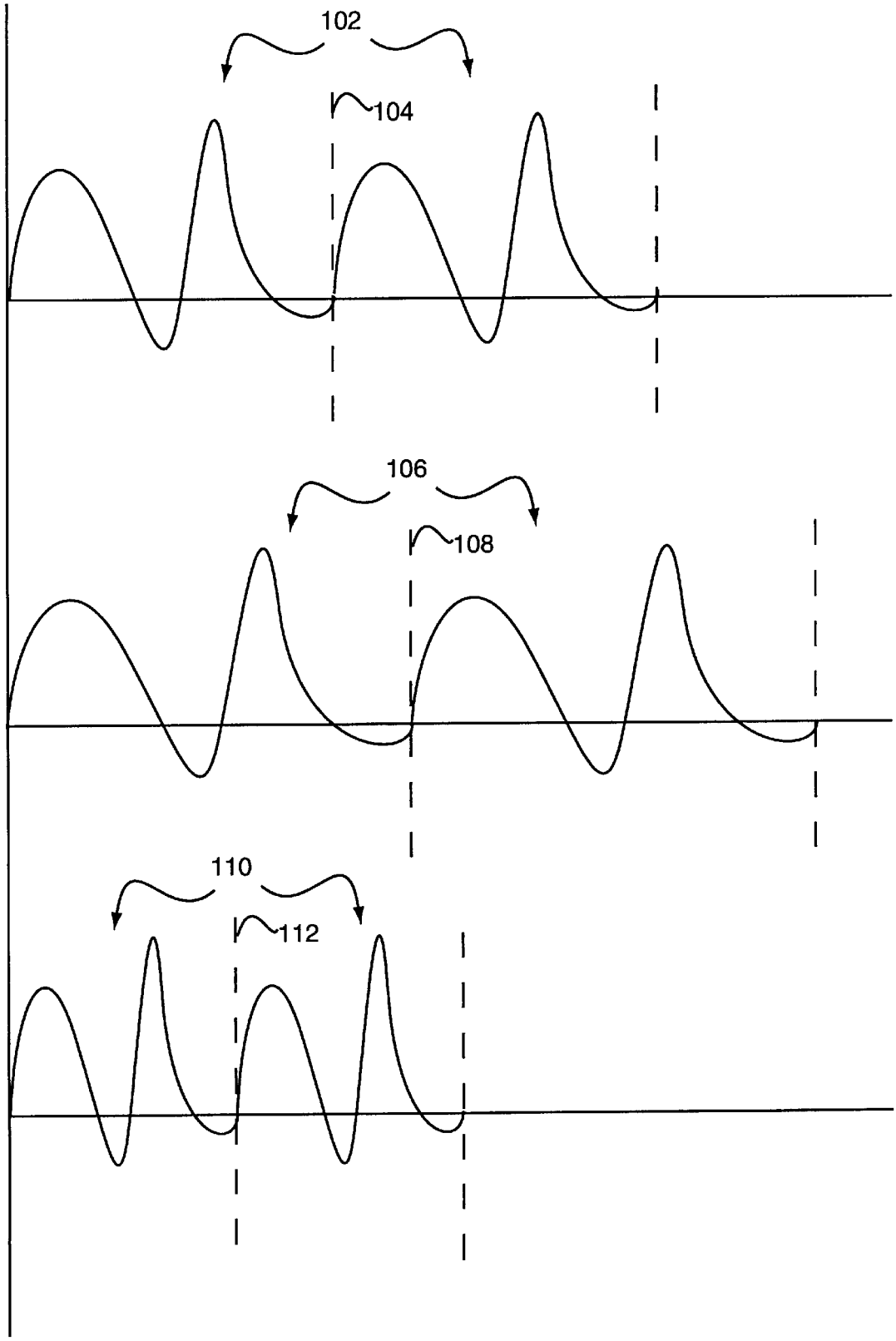
FIG. 1 PRIOR ART
FIG. 1 is an illustration of a series of waveforms, with each illustration spanning two periods of a harmonic signal.
Figure 3:
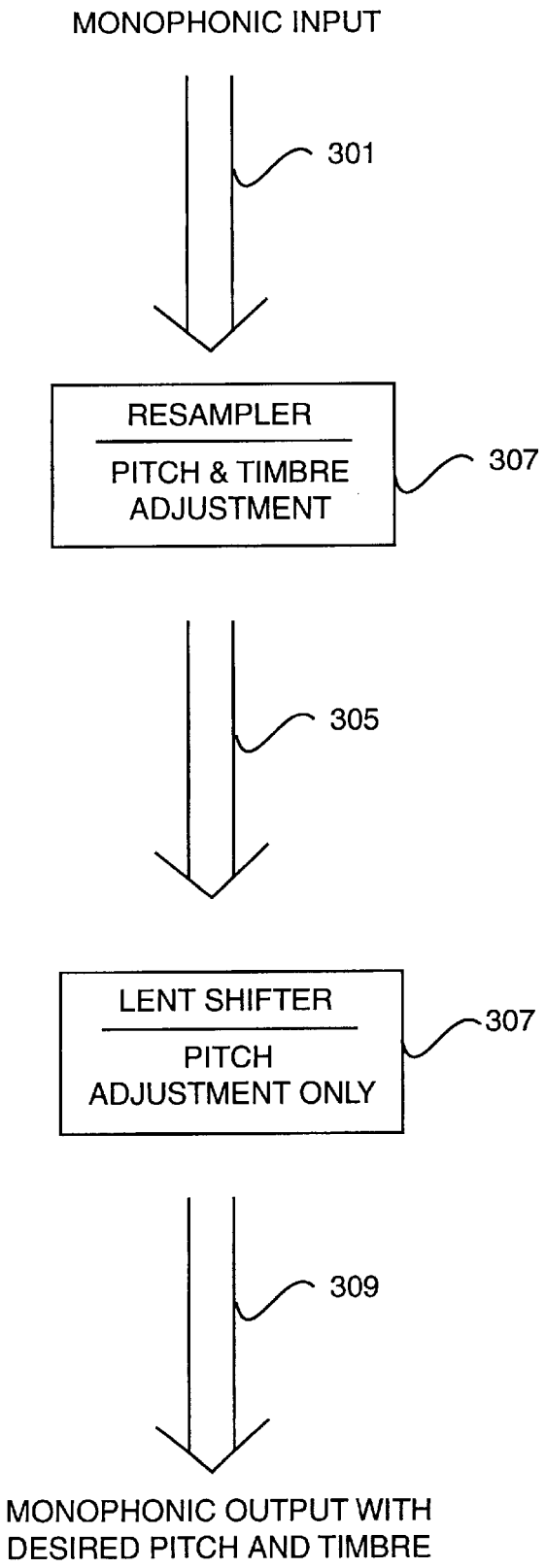
FIG. 3 PRIOR ART
FIG. 3 is a flow diagram showing a combination of resampling and Lent shifting to produce an output signal with an adjusted pitch and timbre.
Figure 4A:
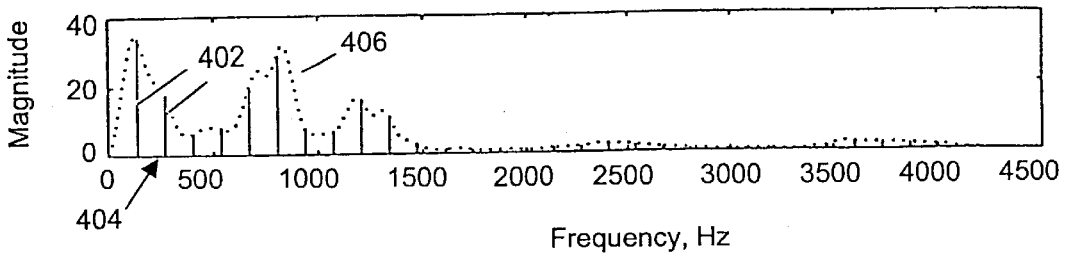
FIGS. 4*a*–4*d* are frequency spectra of vocal or musical notes in various stages of transformation which can be accomplished by a modified Lent shifter as described in the present invention.

FIGS. 4*a* to 4*d* show frequency domain representations of an input signal and its processed counterparts. FIG. 4*a* shows the spectrum of a typical single-pitch harmonic note. The spectrum consists of a series of evenly spaced harmonics 402. Spacings 404 between the harmonics determines the pitch of the note. For clarity, the spectral envelope is plotted as a dotted line 406 above the harmonic peaks. The shape of this envelope determines the timbre of the note.

Figure 4B:
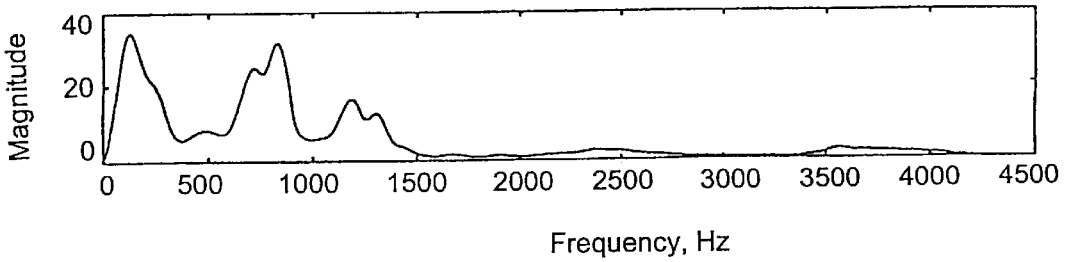
Figure 4C:
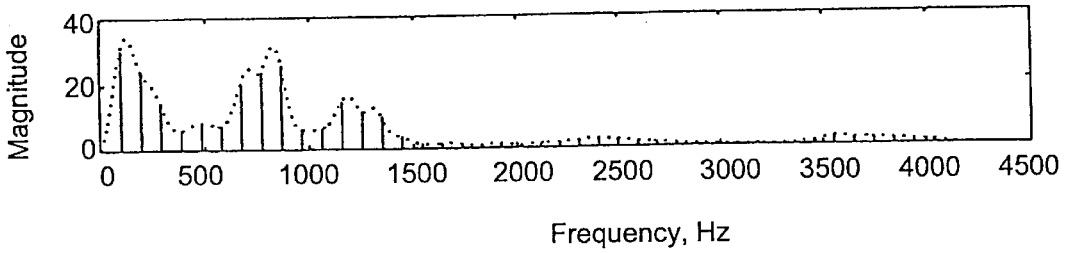

FIG. 4*c* shows the spectrum obtained by processing the signal of FIG. 4*a* with a conventional Lent shifter. The Lent shifter shifts the pitch of the input signal while leaving the spectral envelope the same. First, the Lent shifter performs spectral smoothing by synchronously windowing the input with a window whose length is twice the fundamental period of the input signal. The smoothed spectrum is defined by the convolution of the input spectrum with the spectrum of the window.

The spectrum of the window is shown in FIG. 4*b*. Since the window length is twice the period of the input signal, if a window from the Hanning family is used, its transform will have zeros at all multiples of the distance between consecutive harmonics in the input signal spectrum. The smoothed spectrum will thus take on the same values as the original spectrum at the frequencies of the original signal's harmonics. Between those frequencies, if a window is chosen with small sidelobes in its spectrum, the windowed signal spectrum will be smooth.

FIG. 4*c* shows the result of combining the windowed signal represented in FIG. 4*b* in an overlap-add fashion. Again, the spectral envelope is plotted above the peaks for clarity. The overlap-add process can be thought of as convolving the windowed time signal with an impulse train spaced at the desired pitch period. This corresponds to a multiplication in the frequency domain of the smoothed spectrum of FIG. 4*b* with a harmonic series of impulses at the desired pitch. Thus, the new pitch is impressed upon the smoothed spectrum of FIG. 4*b*. As can be seen, the spectral envelopes in FIGS. 4*a* and 4*c* are the same, which means that the Lent shifted output has the same timbre as the input signal. However, it can also be seen that the spacing between harmonic peaks is less in FIG. 4*c* than in FIG. 4*a*. This means that the pitch of the signal has been shifted down.

Figure 4D:
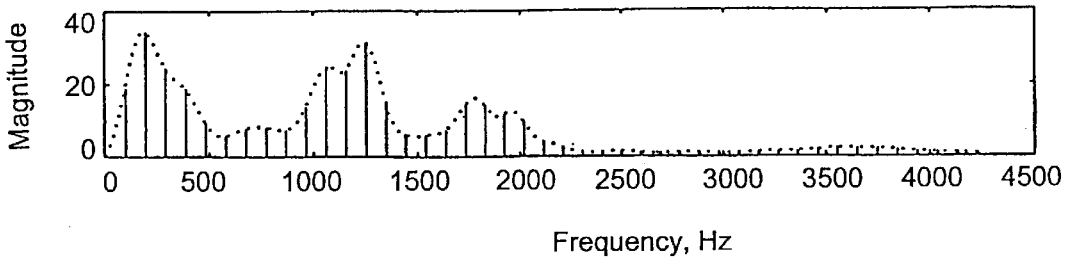

FIG. 4*d* shows a spectral representation of a pitch shifted and timbre adjusted output signal generated in accordance with one embodiment of the present invention. It is created by resampling the windowed segment, represented by the smoothed spectrum of FIG. 4*b*, before the overlap-add process. This resampling step stretches the smoothed spectrum by the desired factor before impressing the new pitch upon it. The timbre or sound of the output signal is adjusted by changing the resampling ratio. Thus, the present invention allows a user to shift the pitch and/or timbre of a vocal or musical note independently, in a controlled manner. FIG. 4*d* shows an output signal which has a stretched spectral envelope, providing a brighter timbre than the input signal, but a smaller harmonic spacing, creating a lower pitch.

Figure 5:
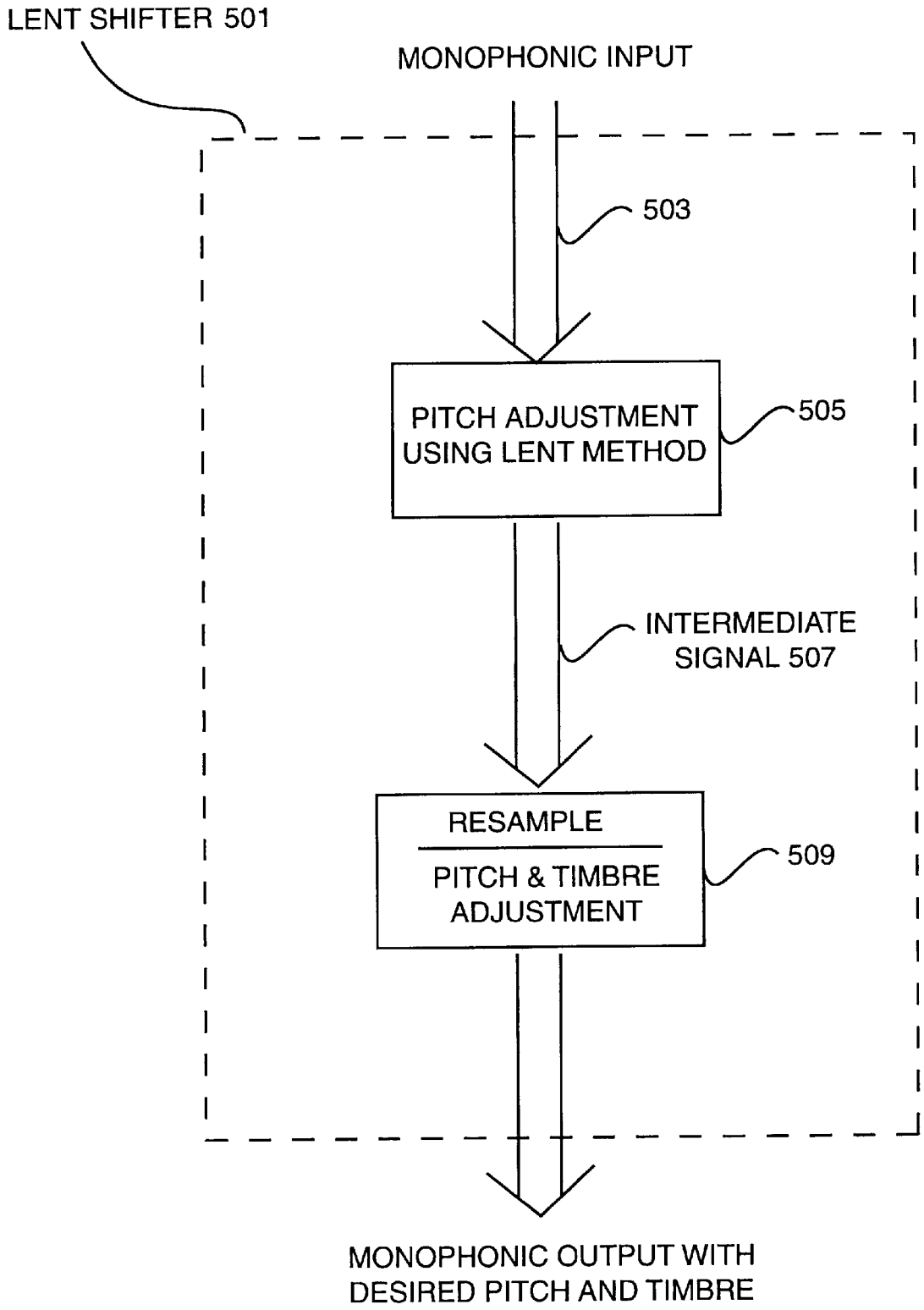
FIG. 5 is a block/flow diagram showing components and the placement of those components in the pitch/timbre shifting system in accordance with one embodiment of the present invention.

FIG. 5 is a block/flow diagram showing broad steps of a pitch/timbre shifting system in accordance with one embodiment of the present invention. A modified Lent shifter 501 is provided with a monophonic input 503. At block 505 the input signal is synchronously windowed, providing a finite length spectrally smoothed signal 507. The windower obtains the window length from the pitch detector 515. In the described embodiment, signal 507 is typically a maximum of 30 mS in length corresponding to a fundamental frequency of 67 Hz. Intermediate signal 507 is routed to a resampler 509. The resampler is not present in a conventional Lent shifter. The resampling step changes the timbre of the signal, producing another finite length signal 511. Signal 511 is over-lap-added by a recombiner 513 at the rate necessary to produce the desired output pitch. The output signal has timbre and pitch that can be independently adjusted.

Figure 6:
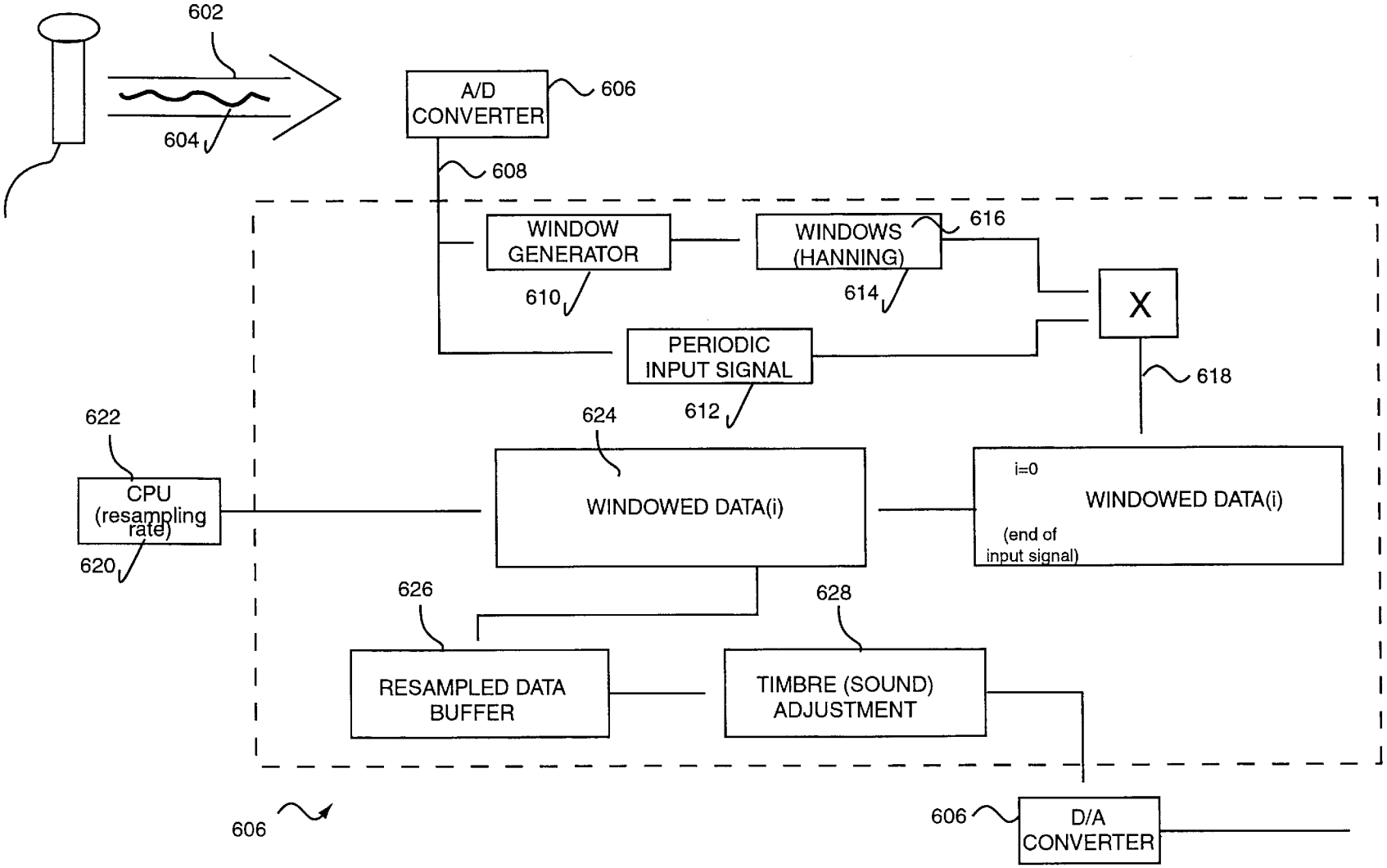
FIG. 6 is a block diagram showing components and the placement of those components in the pitch/timbre shifting system in accordance with one embodiment of the present invention.

FIG. 6 is a block diagram showing components and the placement of those components in the pitch/timbre shifting system in accordance with one embodiment of the present invention. The input to the pitch/timbre adjuster 600 is an input signal 602. The signal can originate from notes sung by a human being or notes played on a musical instrument. In either case, the continuous input signal 602 should have a distinguishable pitch, shown as input 604. An analog/digital converter 606 converts the analog input signal to a corresponding digital signal 608. A pitch detector 610 measures the period of the incoming signal. The pitch detector output is fed to window generator 614. A window which has been stored in ROM within the generator is traversed at a rate such that the window time length is equal to twice the pitch period of the input signal. The input signal is multiplied by the resulting window function 616 to form the windowed signal 618 which is stored in a buffer 624. This data is a finite length signal which contains the original spectral envelope of the input signal.

The windowed data is resampled at resampler 626 at the desired ratio 622 to adjust the timbre of the output. The resampled data is overlap added at 628 to produce an output at the desired pitch. The space between the add pointers in 628 determines the pitch of the output. To generate an output which is a constant musical interval from the input pitch, the output from the pitch detector can be routed to the overlap-add recombiner to be used in computing the output pointer spacing. If an output is desired at a particular musical pitch, the output pointer spacing can be set to a constant. Finally the digital output from the overlap-add recombiner is converted back to analog at 630. The output signal has the appropriately adjusted pitch and timbre.

Figure 7:
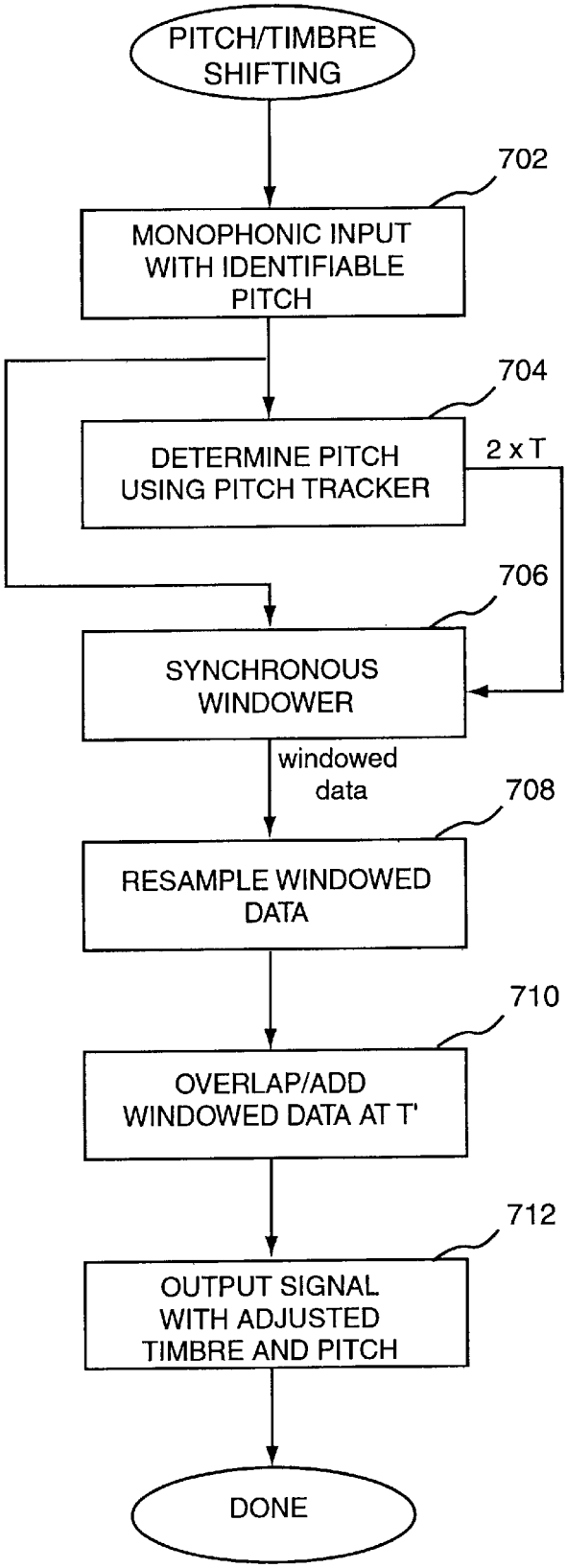
FIG. 7 is a flowchart showing a process of shifting the pitch and timbre of a musical note in accordance with one embodiment of the present invention.

FIG. 7 is a flowchart showing a process of shifting the pitch and timbre of a musical note in accordance with one embodiment of the present invention. At step 702 a pitch/timbre shifter receives an input signal that has a distinguishable pitch. The signal is inputted to a pitch detector at 704 which determines a pitch T. At step 706 the input signal is sent through a synchronous windower where the window length is twice the pitch period of the input signal. In the described embodiment, the window is typically a Hanning window. The windowed data is resampled at step 708. It is at this stage that the timbre of the input signal is shifted if desired. The resampling is done at a predetermined ratio which determines the timbre of the output signal. At step 710 the resampled windowed data is recombined by overlapping and adding. The time T' between overlap-add pointers determines the pitch of the output signal. If T'=T, the output signal will have the same pitch as the input. In general, the output pitch is equal to 1/T'. The pitch of the output signal is independent of the resampling ratio used to produce the data in step 708. The timbre and pitch controls of the described embodiment are thus also independent.

Although the foregoing invention has been described in some detail for purposes of clarity of understanding, it will be apparent that certain changes and modifications may be practiced within the scope of the appended claims. Furthermore, it should be noted that there are alternative ways of implementing both the process and apparatus of the present invention. For example, a window from the Hanning family need not be used. Windows of other lengths can be used to achieve the same goal. Accordingly, the present embodiments are to be considered as illustrative and not restrictive, and the invention is not to be limited to the details given herein, but may be modified within the scope and equivalents of the appended.

What is claimed is:

1. A method of adjusting the pitch and timbre of an input signal, the method comprising:

receiving the input signal;

determining a window length based on the input signal;

creating a finite length spectrally smoothed signal from the input signal by synchronously windowing the input signal;

adjusting the timbre of the finite length spectrally smoothed signal by resampling the finite length spectrally smoothed signal at a predetermined resampling ratio thereby creating a finite length timbre adjusted signal; and recombining the finite length timbre adjusted signal at a rate necessary to produce a desired output pitch thereby reducing artifacts introduced by processing the finite length timbre adjusted signal and minimizing latency between receiving the input signal and producing a desired output signal.

2. A method as recited in claim 1 wherein recombining the finite length timbre adjusted signal further comprises overlap adding the finite length timbre adjusted signal.

3. A method as recited in claim 1 further comprising converting the input signal to a corresponding digital signal.

4. A method as recited in claim 1 wherein determining a window length further comprises measuring the period of the input signal.

5. A method as recited in claim 1 further comprising storing the finite length spectrally smoothed signal in a buffer.

6. A method as recited in claim 1 wherein recombining the finite length timbre adjusted signal further comprises using the window length.

7. A method as recited in claim 1 wherein the finite length spectrally smoothed signal is less than 30 milliseconds.

8. A method as recited in claim 1 wherein adjusting the timbre of the finite length spectrally smoothed signal does not require using a separate data buffer.

9. A method as recited in claim 1 wherein the input signal has a distinguishable pitch.

10. An apparatus for independently shifting the pitch and the timbre of an input signal in a controlled manner, the apparatus comprising:

a pitch detector for determining a window length of an input signal based on the input signal a synchronous windower for creating a finite length spectrally smoothed signal;

a resampler for adjusting the timbre of the finite length spectrally smoothed signal by resampling the finite lens spectrally smoothed signal at a predetermined resampling ratio thereby creating a finite length timbre adjusted signal; and a recombiner for combining the finite length timbre adjusted signal at a rate necessary to produce a desired output pitch, wherein artifacts introduced from processing the finite length spectrally smoothed signal and the finite length timbre adjusted signal are reduced.

11. An apparatus as recited in claim 10 wherein the synchronous windower stores a window that is traversed at a rate such that the window time length is twice the pitch period of the input signal.

12. An apparatus as recited in claim 10 further comprising an analog/digital converter for converting the input signal to a corresponding digital signal and a digital/analog converter for converting the finite length timbre adjusted signal to a corresponding analog signal.

13. An apparatus as recited in claim 10 wherein the resampler receives a resampling rate based on the predetermined resampling ratio.

14. An apparatus as recited in claim 10 further comprising a windowed data buffer for temporarily storing the finite length spectrally smoothed signal.

15. A modified Lent shifter capable of independent timbre and pitch adjustment comprising:

a pitch detector for measuring the period of an input signal;

a synchronous windower for spectrally smoothing the input signal by synchronously windowing the input signal thereby creating a plurality of finite length windowed data;

a resampling timbre adjuster for adjusting the timbre of the input signal using a predetermined resampling ratio on the plurality of finite length windowed data created by the synchronous windower within the modified Lent shifter; and a pitch adjusting recombiner for recombining the plurality of finite length windowed data at a desired rate.

16. A modified Lent shifter as recited in claim 15 wherein the synchronous windower for spectrally smoothing an input signal further comprises using a window having a length that is twice the fundamental period of the input signal.

17. An apparatus for adjusting the pitch and timbre of an input signal, the apparatus comprising:

means for receiving an input signal;

means for determining a window length based on the input signal;

means for creating a finite length spectrally smoothed signal from the input signal by synchronously windowing the input signal;

means for adjusting the timbre of the finite length spectrally smoothed signal by resampling the finite length spectrally smoothed signal at a predetermined resampling ratio thereby creating a finite length timbre adjusted signal; and means for recombining the finite length timbre adjusted signal at a rate necessary to produce a desired output pitch thereby reducing artifacts introduced by processing the finite length timbre adjusted signal and minimizing latency between receiving the input signal and producing a desired output signal.

* * * * *